United States Patent [19]

Hager

[11] 4,371,572

[45] Feb. 1, 1983

[54] PROCESS FOR THE TREATMENT OF WOOD

[76] Inventor: Bror O. Hager, Forsetevagen 5, S-182 63 Djursholm, Sweden

[21] Appl. No.: 235,753

[22] Filed: Feb. 18, 1981

[30] Foreign Application Priority Data

Oct. 10, 1979 [SE] Sweden ..... 7908379

[51] Int. Cl.[3] ..... B05D 3/00; B05D 3/02; B05D 3/12

[52] U.S. Cl. ..... 427/298; 427/351; 427/441; 427/370; 427/393

[58] Field of Search ..... 427/298, 351, 441, 370, 427/393

[56] References Cited

U.S. PATENT DOCUMENTS

| | | | |
|---|---|---|---|
| 2,384,027 | 9/1945 | Hager et al. | 427/298 |
| 3,061,508 | 10/1962 | Morriss et al. | 417/298 |
| 3,560,251 | 2/1971 | Hager | 427/351 |
| 3,889,020 | 6/1975 | Amandsen et al. | 427/298 X |
| 3,995,077 | 11/1976 | Hager | 427/298 |
| 4,303,705 | 12/1981 | Kelso | 417/440 X |

*Primary Examiner*—Michael R. Lusignan

*Attorney, Agent, or Firm*—Burns, Doane, Swecker & Mathis

[57] ABSTRACT

An improved process for the drying/coloring of wood is disclosed wherein the wood is contacted with a drying/coloring oil. At least the outer surface layer of the wood has a moisture content in excess of the fiber saturation point of the wood. The treatment process is carried out until the moisture content of the wood decreases below the fiber saturation point.

11 Claims, No Drawings

PROCESS FOR THE TREATMENT OF WOOD

BACKGROUND OF THE INVENTION

Many processes for the preservative treatment of wood have been developed. Swedish Pat. No. 301,870 discloses the preservative treatment of wood with aqueous solutions followed by the drying/coloring of the wood in a hot high-boiling oil. In another treatment, disclosed in Swedish Pat. No. 401,994, impregnation of the wood takes place in an organic solvent containing a perservative agent followed by drying/coloring in hot oil with simultaneous recovery of the solvent. A third process, disclosed in Swedish patent application No. 7901957-6, discloses the preservative treatment of wood with an emulsion followed by the drying/coloring of wood in hot oil. A fourth treatment, disclosed in Swedish Pat. No. 393,676, discloses a process where a wet (i.e., green) wood is dried by treating the wood in a special oil.

In the first and third treatments discussed above, the wood is impregnated with an aqueous preservative in the form of an actual solution or an emulsion thereof. Subsequently, a drying/coloring step in a high-boiling oil is employed. With such processes the drying/coloring step is generally very successful.

However, when organic solvents are employed as the carrier for the preservation agent, it has not generally been possible to carry out the drying/coloring of the wood as successfully. The coloring pigments are difficult to fix and distribute on the wood in the same successful manner as when an aqueous preservative was initially employed.

When using the treatment intended for drying of the wood as set forth in Swedish Pat. No. 393,676, a very fast and mild drying is obtained as compared to the other three treatments. Contrary to the other treatments, no introduction of oil into the wood surface is desired. In order to avoid such an introduction, a somewhat more evaporable drying medium is used which can be evaporated from the surface of the wood after the drying step. The dried wood is thus freed from the drying medium. As a result of the increased evaporability, a portion of the drying medium evaporates together with the water from the wood during the process. This portion is recovered upon cooling and separated from the water. Another kind of recovery is accomplished by the second treatment discussed above during the heating under vacuum. In that case, however, no drying medium is recovered but only organic solvent for the preservation agent.

DETAILED DESCRIPTION OF THE INVENTION

It has been found that it is difficult to successfully color wood having a low moisture content. It has been surprisingly found, however, that it is not only possible to successfully treat not only wood which has been preserved with an aqueous solution with an oil to dry/-color the wood but also all wet or green wood. Wood can thus be undried (i.e., green) or water-treated in a suitable way to ensure successful drying/coloring. The water content necessary to obtain adequate results can vary somewhat depending on the type of wood which is treated. As a general rule, the wood need only possess a moisture content in excess of the fiber saturation point of the wood.

By way of background, moisture may be present in wood in the form of water or water vapor in wood cell lumens (i.e., cavities). Moisture may also be present as water which is chemically bound to the cell walls of the wood. The fiber saturation point of wood is defined as that moisture content of wood wherein the cell walls of the wood are completely saturated but no water is present in the wood cell lumens. The fiber saturation point of wood (irrespective of the species of wood involved) will generally be about 30 moisture percent. However, the fiber saturation point of various species of wood may vary by several percentage points from that value.

The fiber saturation point may also be defined as the moisture content below which the wood becomes dimensionally unstable and becomes susceptible to swelling and shrinkage. The moisture content of wood is dependent to a great degree upon both the relative humidity and the temperature of the surrounding air. The process needs sufficient moisture to be present in the outer layer of the wood since that is the portion of the wood which is color treated or adjacent to the portion that is. The inner layers of the wood may accordingly be drier than the outer portion of wood. A suitable minimum level for the moisture content of the outer surface layer of the wood (generally about one centimeter in thickness) is about 50 moisture percent (i.e., about 50 grams of water per 100 grams of wood). If the moisture content exceeds about 50 moisture percent, the thickness of the wet layer of the wood can be thinner. The moisture content of the heartwood portion ought to be high since moisture only penetrates a few millimeters of that portion.

Green wood is that wood in which the cells of the wood are saturated with water and which may additionally contain water in the cell lumens. Undried or green wood can thus be dried/colored successfully. If, however, the wood is dried partially or completely prior to the drying or coloring step, the moisture content of the wood may be too low to permit the desired results to be achieved and the wood should be soaked in water or given a thorough spraying with water to increase the moisture content to the necessary extent. Such an impregnation of the wood by soaking or spraying can be limited to the outer parts. It can be carried out with a water pressure of a few kilograms over a period of a few minutes (a short Lowry process is suitable) or the wood can be exposed to a vacuum in the presence of water whereafter it is allowed to absorb water.

Any water treatment of the wood should not be carried out any longer than necessary, as no real advantage thereby is obtained. Instead, prolonged water treatment periods may be disadvantageous. The amount of water introduced into the wood is as a rule less than about 125 kilograms/$m^3$ of wood and this amount is preferably present in the outer parts of the wood.

The drying/coloring treatment of the wood may be carried out in a conventional manner and under conventional conditions such as, for example, in a treatment cylinder. The temperature is preferably maintained around 80° C. (i.e., within the range of about 60° to about 90° C.) and the vacuum is kept high (i.e., in excess of about 600 mm Hg). After the drying/coloring treatment, the oil is removed from the treatment cylinder and the wood is maintained under vacuum. This treatment can be accomplished in a short period of time. As a greater amount of moisture is present in the outer layers of the wood, the treatment can, as a rule, be completed in a few hours. When the amount of water to be evaporated from the wood is small, it is possible to fulfill the drying or coloring step at atmospheric pressure even if this takes more time.

The oils used in the drying or coloring treatment can be the same as in the treatments previously discussed and disclosed in the above-noted Swedish patents. For example, a more detailed description exists in Swedish patent application No. 7908379-6, herein incorporated fully and completely by reference. See also U.S. Pat. No. 3,560,251, herein also incorporated by reference. Suitable oils boil over 300° C. and can be drying or non-drying or a mixture of such oils. As a rule, they are also pigmented. The wood to be treated according to this invention has generally not been colored by preservatives or in any other way. Therefore, it may be possible to vary the colors and to use even light pigments with good results. Further, the oils have no contact with preservative solutions containing special oil destroying copper compounds. Therefore, the drying/coloring oils can be used in many repeated treatments without degradation.

The pigmented oils which are difficult to evaporate impart a permanent color to the wood. Further, surface protection against moisture penetration is provided. Such protection is increased if the oils include a wax or paraffin component in amounts of preferably between about 2 to 5 percent by weight. Further, the drying/coloring oil can contain dissolved agents such as chlorophenol or copper naphthenate to counteract decay, mould and blue stain. The durability of the wood is thus increased. Treatment with such oils can be applied and is quite sufficient for protecting wood which is used where the decay attacks are not heavy, such as for instance, wood which is not in contact with the ground and is not exposed to much moisture. Examples of such wood includes panels, windows, and other wood protected from heavy moisture.

The drying/coloring treatment of the present invention is carried out under suitable conditions of temperature and pressure until the moisture content of the wood falls below the fiber saturation point in order to obtain a good coloring of the wood. As a rule, the drying/coloring treatment is carried out until the moisture content in all parts of the surface of the wood has been reduced to 20 percent by weight or less.

The absorption of oil by the wood surface from the surrounding hot oil during the treatment is dependent upon the kind of wood and how the wood has been stored. Cut pine wood will often absorb about 40 kilograms of oil per $m^3$ of wood. The amount obtained is seldom higher than 60 kilograms per $m^3$ except in cases where the wood has been stored under moist conditions.

It should be noted that the drying/coloring step discussed herein includes the treatment of the wood when the oil are not pigmented and only when the surface of the wood receives an oil protection.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. In a process for the coloring of untreated wood wherein said wood is contacted with a heated pigment-containing drying/coloring oil, the improvement comprising providing untreated wood wherein at least the outer surface layer of the wood has a moisture content in excess of the fiber saturation point of the wood and contacting the wood with a heated pigment-containing drying/coloring oil under temperature and pressure conditions sufficient to remove at least a portion of the moisture from said wood and cause said wood to become pigmented, said contacting being conducted for a period of time sufficient for the moisture content of all parts of said outer surface layer of the wood to decrease below the fiber saturation point of the wood; and removing the treated wood from contact with said oil.

2. The process of claim 1 wherein said contacting step occurs under a vacuum.

3. The process of claim 1 wherein said drying/coloring oil contains preservative agents.

4. The process of claim 1 wherein said contacting step occurs at a temperature of about 80° C.

5. The process of claim 1 wherein said contacting step is conducted for a period of time sufficient for the moisture content of said wood to decrease below about twenty moisture percent.

6. The process of claim 1 wherein at least the outer surface layer of said untreated wood has a moisture content in excess of about 30 moisture percent.

7. The process of claim 6 wherein at least the outer surface layer of said untreated wood has a moisture content in excess of about 50 moisture percent.

8. The process of claim 1 wherein said untreated wood is provided by contacting wood with sufficient moisture to increase the moisture content of at least the outer surface thereof to an amount in excess of the fiber saturation point of the wood.

9. The process of claim 8 wherein said wood is soaked in or sprayed with water to increase the moisture content of at least the outer surface layer in excess of the fiber saturation point prior to contacting said wood with the drying/coloring oil.

10. The process of claim 9 wherein said water treatment occurs under a vacuum.

11. The process of claim 2 wherein the wood is maintained under a vacuum during removal of the wood from contact with the drying/coloring oil.

* * * * *